United States Patent [19]

May et al.

[11] Patent Number: 4,900,289

[45] Date of Patent: Feb. 13, 1990

[54] MECHANISM FOR ANIMATING A DOLL'S FACIAL FEATURES

[75] Inventors: Richard L. May, Manhattan Beach; Kenneth J. Curran, Thousand Oaks, both of Calif.

[73] Assignee: Cal R&D, Inc., Culver City, Calif.

[21] Appl. No.: 149,712

[22] Filed: Jan. 29, 1988

[51] Int. Cl.[4] ..... A63H 3/36; A63H 3/40

[52] U.S. Cl. ..... 446/342; 446/343; 446/301

[58] Field of Search ..... 446/342, 343, 337, 300, 446/301, 338, 352, 353, 354, 355; 40/416

[56] References Cited

U.S. PATENT DOCUMENTS

| | | | |
|---|---|---|---|
| 754,825 | 3/1904 | Spencer et al. | 40/416 X |
| 2,660,830 | 12/1953 | Jentzen | 446/342 |
| 2,706,364 | 4/1955 | Yakooleff | 446/342 |
| 3,722,136 | 3/1973 | Thorn et al. | 446/354 |
| 4,346,893 | 8/1982 | Landsinger et al. | 446/353 X |

*Primary Examiner*—Mickey Yu

*Attorney, Agent, or Firm*—Price, Gess & Ubell

[57] ABSTRACT

A mechanism for animating a doll's jaw, eyes and eyelids. A single motor powers all three movements. The eyes and jaw are connected to the motor such that they continually move while the motor is in operation, while the eylids are connected to the motor such that reversal of the direction of rotation of the motor causes the eyelids to blink once. All movements are therefore controlled by controlling the speed and direction of rotation of the motor. Thus, movement of the jaw can be synchronized with a sound track, the eyes move in an apparently random path, and the eyelids blink at random intervals independent of the other facial features' position or movements.

14 Claims, 2 Drawing Sheets

MECHANISM FOR ANIMATING A DOLL'S FACIAL FEATURES

BACKGROUND OF THE INVENTION

1. Field of the Invention

The present invention relates generally to improvements in mechanisms that serve to animate a doll's facial features, and, more particularly, pertains to a mechanism in which a single motor drives simulated jaw movement, eyeball movement and eyelid movement. The eyelid movement is achieved in a manner such that it can be initiated at any time independent of jaw or eyeball position.

2. Description of the Prior Art

Miniaturization of electronic circuitry has enabled the incorporation of a surprising amount of sophisticated capability within a doll's interior. The coordinated movement of legs, arms, hands, head and various facial features has become a rather commonplace ability of modern dolls. In addition, such movements can be coordinated with a sound track emanating from the doll. An increased number of movements that are coordinated with a sound track results in a more lifelike appearance.

Numerous mechanisms have been devised to animate various facial features of dolls or mannequins to impart a more lifelike appearance. Movement of eyes and eyelids are critical for such lifelike animation, and, if the doll is to speak, movement of the mouth or jaw is also most desirable. Mechanisms have been disclosed that serve these three functions as, for example, in U.S. Pat. No. 2,641,866. Typically, an electric motor, wound spring or other drive means, is employed to rotate a series of gears, pulleys, cams and cranks that actuate various followers, levers, rods and arms to achieve this animation.

A shortcoming of mechanisms that are driven by a single drive means is that the sequence of movements is typically very repetitive, therefore rather predictable, and as a result, has a rather artificial appearance. While the use of complex cam profiles somewhat lessens the movements' rather "mechanical" appearance, independence of one movement from another is not thereby achieved. For instance, it could be observed that for every so many eye movements or jaw movements, the eyelids are blinked. Incorporation of additional drive means provides more degrees of independence but complicates matters by increasing size, weight, cost and complexity. Similarly, addition of mechanisms that can selectively couple and decouple certain functions from a single drive means increases complexity and cost.

SUMMARY OF THE INVENTION

An object of the present invention is to provide a mechanism by which three separate types of movement can be imparted to a doll's facial features, all being controlled and driven by a single drive means.

It is a further object of this invention that at least one of the types of movement can be initiated completely independently of the other two types of movement.

It is yet another object of this invention that the mechanism be as small as possible and that the movements can easily be orchestrated by remote means.

According to the present invention, the foregoing and other objects are attained by a unique arrangement of gears, pulleys, cranks and couplings whereby a single drive means can simultaneously power different types of movements so that they appear to operate independently of one another. While one type of movement is continuously driven while the drive means is operational, the other type of movement is limited to a specified number of cycles, initiated whenever the direction of rotation of the drive means is reversed. This arrangement has the advantage that when, for example, adapted to drive various facial movements in an animated doll, by simply controlling the voltage supplied to a bidirectional motor, the rate of eye and jaw movement can be controlled while the eyelids can be "blinked" whenever desired by simply reversing the voltage bias.

A further advantage of the present invention is that the entire mechanism is compact and can therefore be entirely accommodated within, for example, a doll's head.

BRIEF DESCRIPTION OF THE DRAWINGS

Other objects and many of the attendant advantages of this invention will be readily appreciated as the same becomes better understood by reference to the following detailed description when considered in conjunction with the accompanying drawings, in which like reference numerals designate like parts throughout the figures thereof, and wherein.

DETAILED DESCRIPTION OF THE PREFERRED EMBODIMENT

The following description is provided to enable any person skilled in the electrical and mechanical toy fields to make and use the present invention, and sets forth the best modes contemplated by the inventor of carrying out his invention. Various modifications, however, will remain readily apparent to those skilled in the art, since the generic principles of the present invention have been defined herein specifically to provide an improved doll having animated facial features.

The mechanism described herein can be incorporated in a doll containing audio reproduction and control equipment which, in addition to having a sound track, generates signals for powering an electric motor at various intervals, at varying speeds and in different directions.

Figure 1:
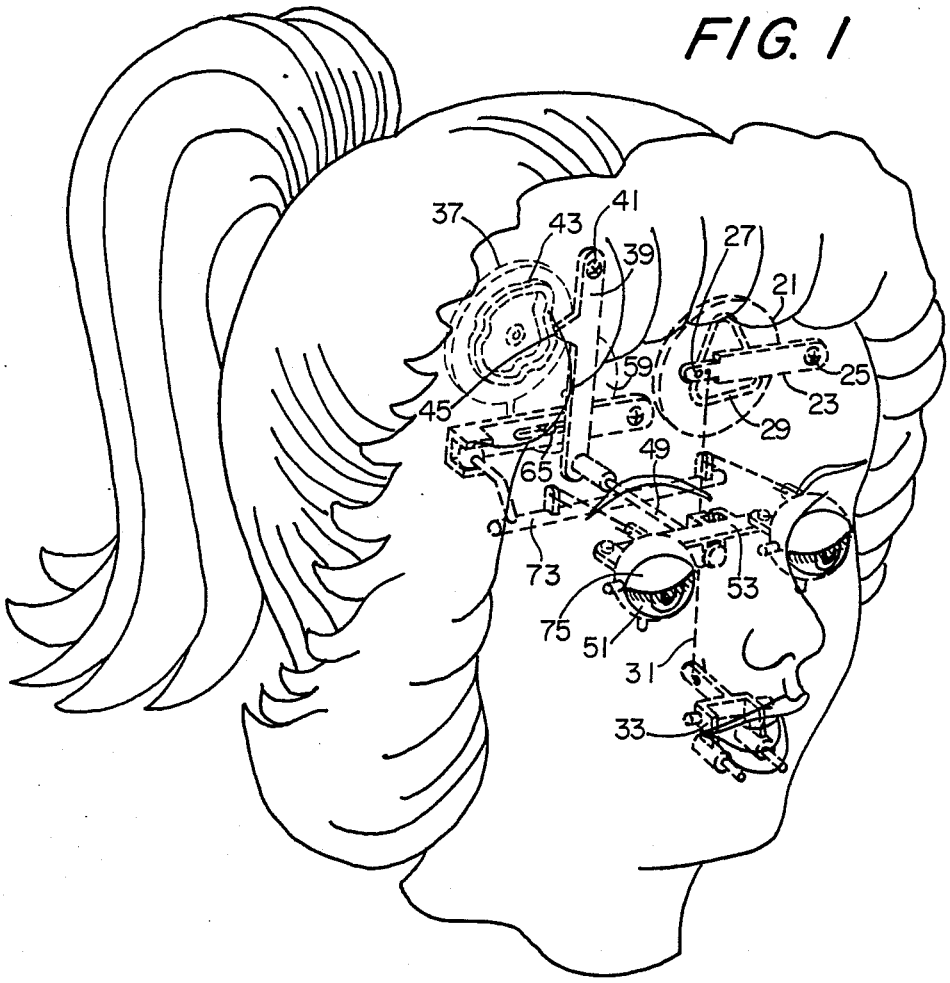
FIG. 1 is a perspective view of components of the mechanism of the present invention as arranged inside a doll's head.
Figure 3:
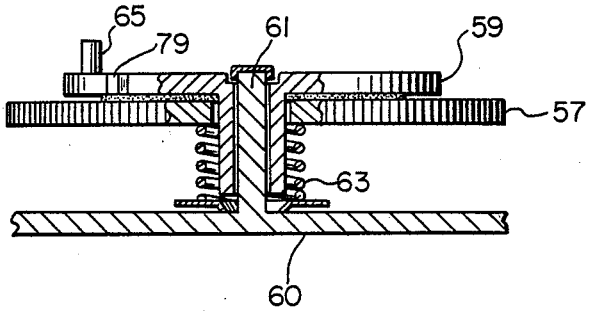
FIG. 3 is an elevated side view of the friction coupling.

The entire mechanism, including its electric motor, is arranged within a doll's head as is illustrated in FIG. 1. The mechanism powers movement of the eyes, the jaw and the eyelids. Signals generated elsewhere within the doll, which can, for example, be read off a magnetic tape, coordinates and synchronizes the various movement. Jaw movement can be synchronized with a voice track, while eyes can scan in a continuous sequence. In addition, the eyelids can be blinked at apparently random intervals. All these functions are controlled by a single pair of leads that supply the voltage to the electric motor.

Figure 2:
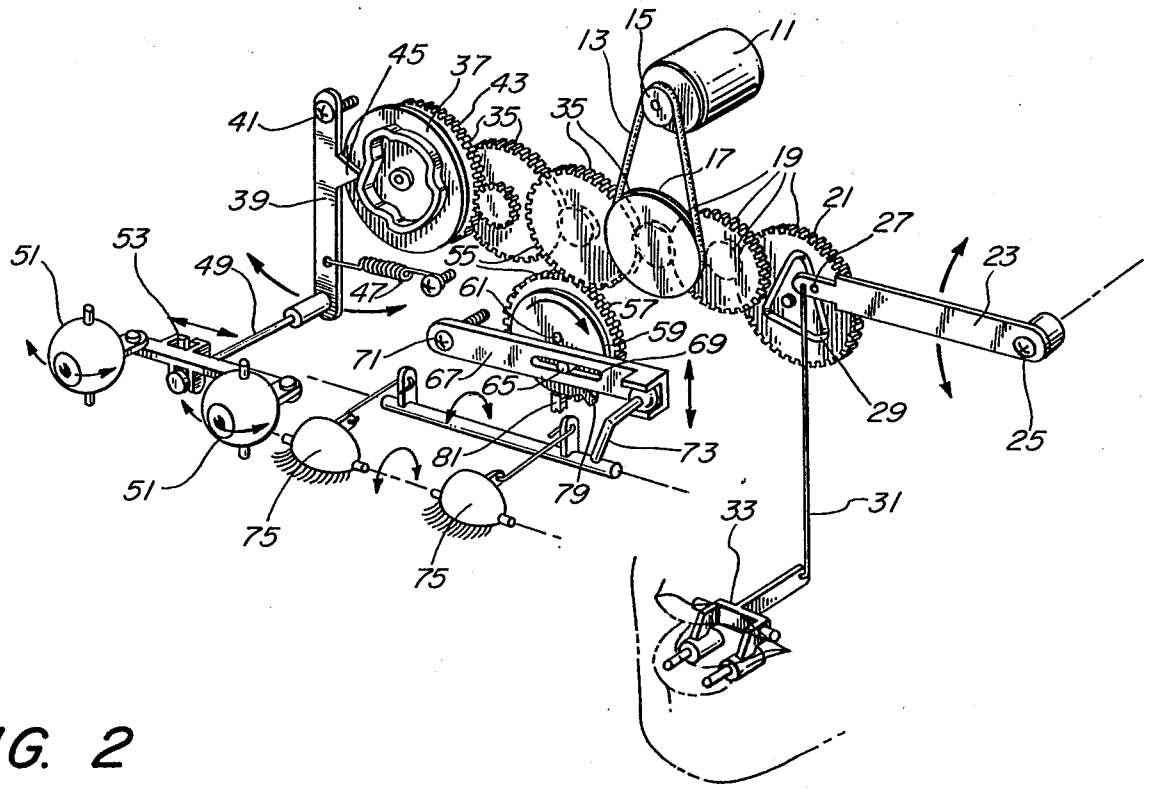
FIG. 2 is a schematic representation of the mechanism of the present invention.

FIG. 2 schematically illustrates a mechanism of the present invention. A single drive means powers all functions of this mechanism. The drive means 11 may, for example, be an electric motor capable of variable speeds in both forward and reverse rotation. A pair of pulleys 15, 17 transfers the rotation from the motor to the gear trains via drive belt 13. The utilization of a belt and pulleys at this point serves to both reduce the rate of rotation and to provide a built-in safety feature. In the event one of the gear trains should become jammed or one of the drive movements is in some way restricted, slippage of the belt 13 will prevent the electric motor 11 from burnout. Rotation of pulley 17 is transferred to the rotation of a cam 21 via gear train 19. Cam 21 has a complex profile 29 in the form of a groove. Lever 23 is pivotably attached at 25, and has a peg 27 which rides in the groove. This causes a generally up and down motion of the arm as the cam is rotated. A connecting rod 31 connects this movement to the movement of the mouth or jaw of the doll 33. The speed of the motor 11 can be altered as is necessary to coordinate the jaw movement with the rate of speech or can be stopped during moments of silence. It is to be observed that the net jaw movement is unaffected by the direction of rotation of the cam or motor.

A second gear train 35 translates the rotational movement of pulley 17 to cam 37. A lever arm 39 appropriately positioned and pivoting about 41 follows the complex cam profile 43 via cam follower 45. A spring 47 urges the lever against the cam surface. The linkage 49 links this movement to a side-to-side movement of eyeballs 51 and tie rod 53 ensures a coordinated movement of both eyeballs. The transfer ratio of gear train 35 serves to drive cam 37 at a much lower rate than cam 21, as the resulting eye movement must be considerably slower than the jaw movement to impart a realistic animation. Again, it is to be observed that this movement is unaffected by the actual direction of rotation of the motor. Seemingly random scanning of the eyeballs from side to side appears equally as random in either direction of rotation of 37.

A third gear train 55 translates the rotational movement to gear 57. As is illustrated in FIG. 2, friction disk 59 is concentrically disposed above gear 57 via axle 61. Both gear 57, the drive member, and friction disk 59, the driven member, are free to rotate about axle 61. A coil spring 63, disposed about axle 61 in compression between 57 and a portion of the housing 60, urges gear 57 against friction disk 59 and thereby frictionally links the rotation of the two components. A peg 65 projects up above the surface of the friction disk 59 in a direction parallel with the axis 61. This positioning in effect renders its operation that of a crank. Arm 67 pivots around 71 and slot 69 engages peg 65 such that rotation of friction disk 59 results in an up and down motion of crank 67. The lever 67 is further linked 73 to eyelids 75. Tie rod assembly 77 ensures that the movement of the two eyelids is coordinated. A radial projection 79 at the periphery of friction disk 59 prevents the rotation of the friction disk beyond rotation limiter 81, which is rigidly affixed in close proximity to this mechanism. Rotation of the friction disk is therefore limited to one single rotation in either direction, but never more than this at any time. Once the projection 79 engages the stop member 81, further rotation of gear 57 merely causes slippage of the spring against the friction disk 59. One complete rotation of friction disk 59 causes a blinking, i.e., movement of eyelids from an open to a shut to an open position. Any time the direction of rotation of motor 11 is reversed, such a blinking ensues. Again, it is to be noted that the blinking action has the identical appearance regardless of the direction of rotation. The speed of the rotation of friction disk 59 is much higher than any of the other two functions, as the desired motion must be considerably faster to impart a lifelike appearance of a blink.

The entire mechanism can easily be accommodated within the doll's head, as is illustrated in FIG. 1, when a much more efficient use of space is employed than is suggested by the schematic arrangement of FIG. 2. FIG. 1 illustrates the layout of the cams, levers and linkages operating the eyes 51, eyelids 75 and jaw 33. The gear trains have been omitted so as not to obstruct the view, but can easily be incorporated by one skilled in the art to transfer rotation from a motor (not shown) to the various actuators. The three-dimensional layout makes more efficient use of space in that the cams 21, 37 and crank/friction disk 59 can be positioned one behind the other and the various levers 23, 39, 73 can be arranged wherever space permits within the doll's head. Gear trains can overlay and various gears can share shafts to further conserve space.

This mechanism therefore allows complete control of the three facial features of a doll by the power supplied to the motor. In order to coordinate jaw movement with a voice track, power supplied to the motor can either be increased, decreased, or discontinued. Since the rate of movement of the eyeballs is considerably slower than the rate of movement of the jaw, a slight increase or decrease in the rate of movement of the jaw is not easily discernible in the movement of the eyeballs. Such an arrangement gives the appearance of independence of movement. In addition, neither motion is affected by the direction of rotation of the motor. Whenever it is desired to cause the doll's eyes to blink, the direction of rotation of the motor is simply reversed by reversing the polarity of the power supplied. The ensuing blinking of the eyes has no apparent effect on jaw movement or eyeball movement. The signals necessary to cause the proper voltage to be applied to the motor, for example, can be included on the magnetic tape recording that provides the sound track which is to emanate from the doll and towhich the doll is to move.

Obviously, many modifications and variations of the present invention are possible in light of the above teaching. It is therefore to be understood that within the scope of the appended claims, the invention may be practiced otherwise than as specifically described herein.

What is claimed is:

1. In an animated figure designed for movement of certain parts thereof, a mechanism contained therein for moving said parts in a seemingly independent manner, said mechanism comprising:

a bidirectional motor capable of continuous rotation in either direction upon selection;

a first moveable part;

a second moveable part;

means interconnecting said bidirectional motor to said first and second moveable parts for moving said first and second moveable parts in directions independent from each other in response to said bidirectional motor rotating in either direction;

said interconnecting means including:

a specific friction drive coupling of establishable limits rotated by said motor;

a means for linking said friction coupling with said second moveable part; and a means for impeding motion of said friction drive coupling after a certain number of rotations in either direction, at which point slippage in the coupling allows the motor to continue rotating, whereby the second moveable part only moves upon a change in direction of rotation of the motor.

2. The animated figure of claim 1 wherein said interconnecting means further includes:

a cam directly rotated by the motor;

a cam follower urged against the cam's surface; and a linkage for transferring movement of the cam follower to said first moveable part, whereby the first moveable part moves whenever the motor rotates, regardless of the direction of rotation.

3. The animated figure of claim 2 wherein the first moveable part comprises a pair of eyeballs pivotably mounted in said animated figure whereby the linkage transferring movement from the cam follower imparts a side-to-side motion of the eyeballs when the motor is in its continuous rotation mode.

4. The animated figure of claim 2 wherein the first moveable part comprises a jaw section pivotably mounted in said animated figure whereby the linkage transferring movement from the cam follower imparts an up and down motion of the jaw when the motor is in its continuous rotation mode.

5. The animated figure of claim 1 wherein the second moveable part comprises a pair of eyelids pivotably mounted in said animated figure and the means for linking the friction coupling comprises a crank assembly whereby a single rotation of the friction coupling translates to a closing and opening motion of the eyelids.

6. The animated figure of claim 5 wherein the means for impeding motion of the friction drive coupling comprises a peg disposed in the path of the crank such that the crank can turn through only one rotation in either direction.

7. In an animated doll having a simulated face with various facial features capable of movement, the improvement comprising:

a single bidirectional drive means;

means for operatively connecting the drive means to a first facial feature capable of movement so that the first facial feature continuously cycles through its movement capabilities while the drive means is operational;

means for operatively connecting the drive means to a second facial feature capable of movement so that the second facial feature moves for only a limited amount of time upon a change in direction of rotation of the drive means; and means for changing the direction of rotation of the drive means.

8. The animated doll of claim 7 wherein the bidirectional drive means comprises a single reversible electric motor and the means for changing the direction of rotation of the motor comprises a means for biasing voltage supplied to the motor.

9. The animated figure of claim 8 wherein the means for operatively connecting the drive means to the second facial feature capable of movement comprises:

a friction coupling;

means for rotationally connecting the motor to the friction coupling;

means for operatively connecting the friction coupling to the second facial feature capable of movement; and means for restricting the number of rotations in each direction transferred through the friction coupling, whereby, upon a change in direction of rotation of the motor, a limited number of rotations are transferred through the friction coupling after which transfer is restricted and the friction coupling slips until the direction of rotation of the motor is again changed.

10. A mechanism for animating a doll's eyelids, eyeballs and jaw, comprising:

a motor capable of forward and reverse rotation;

a first cam driven by said motor;

a first linking means for transferring motion of the first cam to an up and down motion of the jaw;

a second cam driven by said motor;

a second linking means for transferring motion of the second cam to a side-to-side motion of the eyeballs;

a crank mechanism;

a friction coupling coupling rotation of said motor with the crank mechanism;

a third linking means for transferring motion of the crank mechanism to a closing and opening motion of the syslids; and a rotation limiter disposed within the path described by the crank mechanism to prevent rotation beyond the rotation limiter's position, whereby rotation of the motor in either direction imparts an up and down motion to the jaw and a side-to-side motion to the eyeballs, and, additionally, causes the eyelids to blink whenever the motor changes direction of rotation.

11. The animation mechanism of claim 10 wherein the first cam and second cam have complex profiles which impart multiple reciprocations of varying amplitude in a single rotation.

12. The animation mechanism of claim 10 wherein the friction coupling comprises:

a shaft;

a rotating drive member rotatably affixed to the shaft;

a rotatable driven member rotatably affixed to the shaft; and a coil spring concentrically disposed about the shaft and in compression engagement with the drive member, whereby pressure of the spring against the drive member causes frictional engagement of the drive member with the driven member and rotation of the driven member.

13. The animation mechanism of claim 12 wherein the driven member comprises a flat disc, one face engaging the drive member and the other face having a peg affixed thereto in parallel to but not coincident with said shaft, whereby in this arrangement the driven member functions as the crank mechanism.

14. The animation mechanism of claim 13 wherein the third linking means comprises in part, a lever, pivotably mounted near its first end in proximity to the crank mechanism, having a centrally-located slotted section engaging the peg and its second end attached to the eyelids, whereby a rotation of the peg about the shaft transfers a reciprocating movement to the second end of the lever.

* * * * *